US005743353A

United States Patent [19]

Browning et al.

[11] Patent Number: 5,743,353

[45] Date of Patent: Apr. 28, 1998

[54] TREE STEP SOCKET

[76] Inventors: Paul Ray Browning, 1009 Cooper Dr., Oak Grove, Ky. 42262; Paul Ray Browning, Sr., 5233 Sedalia Dr., Columbus, Ohio 43232

[21] Appl. No.: 725,175

[22] Filed: Oct. 3, 1996

[51] Int. Cl.[6] ..... E06C 9/00

[52] U.S. Cl. ..... 182/92; 81/121.1

[58] Field of Search ..... 182/92; 81/121.1, 81/124.2, 124.3, 124.7, 176.1

[56] References Cited

U.S. PATENT DOCUMENTS

| | | | |
|---|---|---|---|
| 887,643 | 5/1908 | Jackson | 81/124.2 |
| 1,181,565 | 5/1916 | Block | 81/124.2 |
| 1,276,953 | 8/1918 | Parker | 81/121.1 |
| 3,071,995 | 1/1963 | Ruthrauff, Jr. | 81/124.2 |
| 3,380,697 | 4/1968 | Melcher . | |
| 3,868,874 | 3/1975 | Olashaw | 81/121.1 |
| 4,096,621 | 6/1978 | Berger et al. | 81/124.2 X |
| 4,413,706 | 11/1983 | Michael . | |
| 4,669,575 | 6/1987 | Skyba . | |
| 4,697,669 | 10/1987 | Bergsten . | |
| 4,700,807 | 10/1987 | Kubiak . | |
| 4,867,272 | 9/1989 | Troubridge . | |
| 4,970,921 | 11/1990 | Fagan | 81/121.1 |
| 5,279,388 | 1/1994 | Laughlin et al. . | |
| 5,549,022 | 8/1996 | Knox | 81/124.2 |

*Primary Examiner*—Ramon O. Ramirez
*Assistant Examiner*—Richard M. Smith
*Attorney, Agent, or Firm*—Richard C. Litman

[57] ABSTRACT

A socket for allowing a ratchet to be used to screw a folding tree step into or out of a tree trunk. The socket has two C-shaped brackets which are perpendicularly oriented relative to one another. With the foot peg of the tree step folded alongside the main support bar of the tree step, one bracket fits around the foot peg while the other bracket fits around the end of the main support bar to which the screw portion of the tree step is attached.

5 Claims, 4 Drawing Sheets

TREE STEP SOCKET

BACKGROUND OF THE INVENTION

1. Field of the Invention

The present invention relates to a socket for allowing a driver tool such as a ratchet to be used for screwing a tree step into and out of a tree trunk.

2. Description of the Prior Art

One of the most productive hunting methods in wooded areas in recent years has been hunting from a tree stand. Hunting from a tree stand involves installing a tree stand at a considerable height on a tree trunk, climbing into the tree stand, and waiting for a game animal to wander sufficiently close to the tree stand to be within the range of the weapon used by the hunter perched on the tree stand.

To facilitate the climb up to and down from the tree stand, tree steps that screw into the trunk of trees are used. Usually a number of these tree steps are screwed into the trunk of the tree, along the length of the tree trunk with successive tree steps being mounted on alternating sides of the tree trunk.

The typical tree step includes a main bar, a foot peg hingedly attached to one end of the main bar, and a screw portion hingedly attached to the other end of the main bar. To install the tree step on a tree trunk, the foot peg and the screw portion are unfolded so as to project perpendicularly from the main bar. Then using the foot peg as a crank handle, the screw portion is screwed into the tree trunk. To remove the tree step, the foot peg is again used as a crank handle but this time the foot peg is turned in the opposite direction to unscrew the tree step from the tree trunk. However, this operation is rather taxing physically because the relatively short main bar does not afford a long enough moment arm to easily screw the screw portion into or unscrew the screw portion out of the tree trunk. Therefore, the need exists in the art for a means that allows a commonly available tool such as a ratchet or a power driver, to be used to screw a tree step into or out of a tree trunk.

U.S. Pat. No. 3,380,697, issued to Norman J. Melcher on Apr. 30, 1968, shows a tree step that screws into the tree trunk. Melcher does not show a socket engageable by a ratchet, which can be used to screw the tree step into or out of the tree trunk.

U.S. Pat. No. 4,414,706, issued to Bayard H. Michael on Nov. 8, 1983, shows a tree step that screws into the tree trunk. Michael does not show a socket engageable by a ratchet, which can be used to screw the tree step into or out of the tree trunk.

U.S. Pat. No. 4,669,575, issued to Helmut K. Skyba on Jun. 2, 1987, shows a tree step that screws into the tree trunk. Skyba does not show a socket engageable by a ratchet, which can be used to screw the tree step into or out of the tree trunk.

U.S. Pat. No. 4,697,669, issued to Arvid H. Bergsten on Oct. 6, 1987, shows a tree step that screws into the tree trunk. Bergsten does not show a socket engageable by a ratchet, which can be used to screw the tree step into or out of the tree trunk.

U.S. Pat. No. 4,700,807, issued to Robert E. Kubiak on Oct. 20, 1987, shows a tree step with a detachable screw portion that screws into the tree trunk. Kubiak does not show a socket engageable by a ratchet, which can be used to screw the tree step into or out of the tree trunk.

U.S. Pat. No. 4,867,272, issued to William C. Troubridge on Sep. 19, 1989, shows a tree step that can be used as a wrench to screw a hexagonal head screw in a tree trunk. The tree step can then be hung from the hexagonal head screw. Troubridge does not show a socket engageable by a ratchet, which can be used to screw the tree step into or out of the tree trunk.

U.S. Pat. No. 5,279,388, issued to Michael K. Laughlin et al. on Jan. 18, 1994, shows a tree step that screws into the tree trunk using a hexagonal head screw. Laughlin et al. do not show a socket engageable by a ratchet, which can be used to screw the tree step into or out of the tree trunk.

None of the above inventions and patents, taken either singly or in combination, is seen to describe the instant invention as claimed.

SUMMARY OF THE INVENTION

The present invention provides a socket for allowing a ratchet to be used to screw a folding tree step into or out of a tree trunk. The socket has two C-shaped brackets which are perpendicularly oriented relative to one another. With the foot peg of the tree step folded alongside the main support bar of the tree step, one bracket fits around the foot peg while the other bracket fits around the end of the main support bar to which the screw portion of the tree step is attached.

Accordingly, it is a principal object of the invention to provide a socket which allows a ratchet to be used to screw a tree step into or out of a tree trunk.

It is another object of the invention to reduce the effort required for screwing a tree step into or out of a tree trunk.

It is a further object of the invention to provide a socket for screwing a tree step into or out of a tree trunk, which is engageable by currently available standard ratchets.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 5:
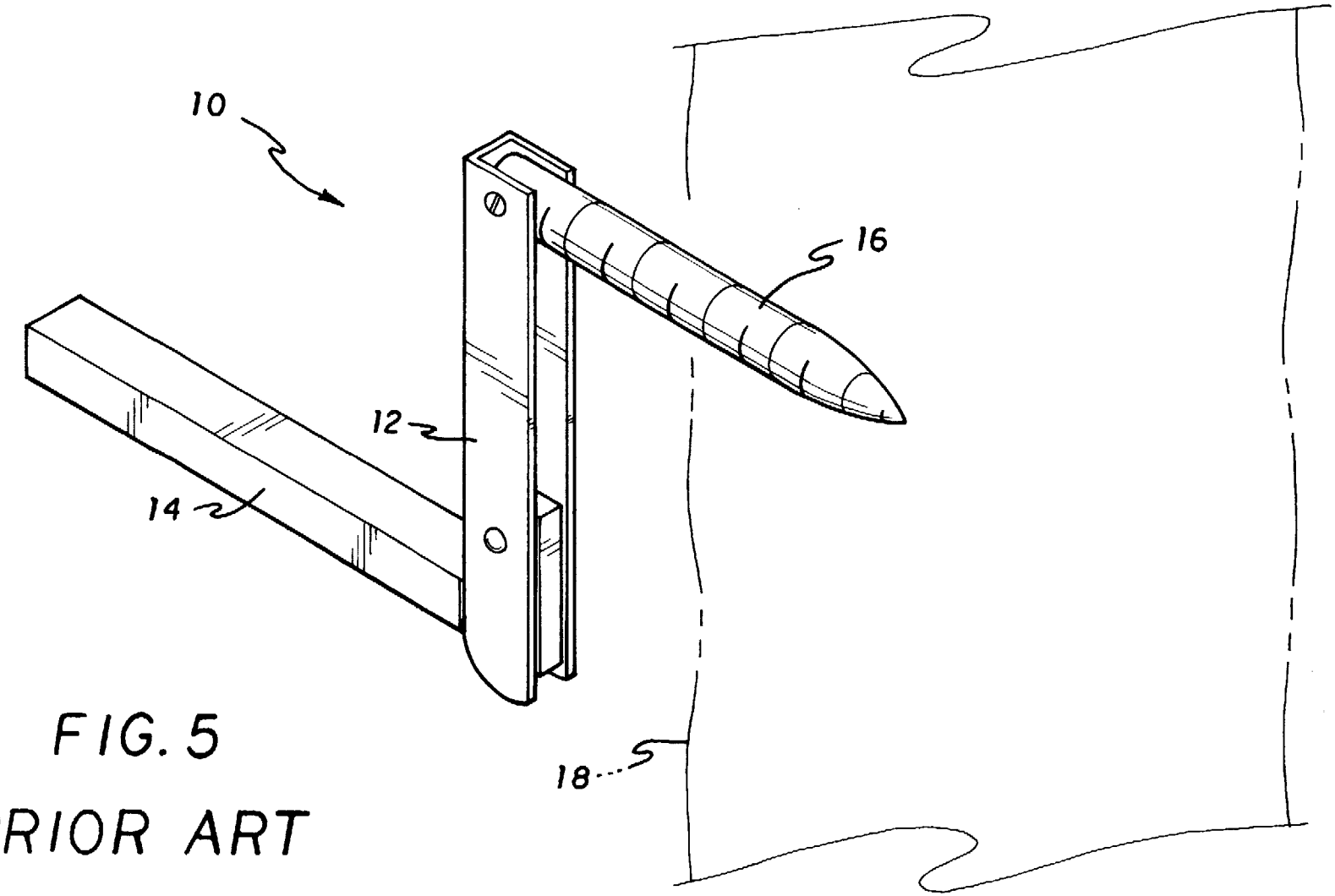
FIG. 5 PRIOR ART
FIG. 5 is an environmental perspective view of a tree step of the type which can be screwed into or out of a tree trunk using the socket of the present invention.

The present invention is directed to a socket for allowing a ratchet to be used to screw a tree step into or out of a tree trunk. Referring to FIG. 5, a tree step 10 of the type which can be screwed into or out of a tree trunk using the socket of the present invention, can be seen. The tree step 10 includes a main bar 12 having a first end and a second end, a foot peg 14 hingedly attached to the first end of the main bar 12, and a screw portion 16 hingedly attached to the second end of the main bar 12. To install the tree step 10 on a tree trunk 18, the foot peg 14 and the screw portion 16 are unfolded so as to project perpendicularly from the main bar 12. Then using the foot peg 14 as a crank handle, the screw portion 16 is screwed into the tree trunk 18. To remove the tree step, the foot peg 14 is again used as a crank handle but this time the foot peg 14 is turned in the opposite direction to unscrew the screw portion 16 from the tree trunk 18. However, this operation is rather taxing physically because the relatively short main bar 12 does not afford a long enough moment arm to easily screw the screw portion 16 into or unscrew the screw portion 16 out of the tree trunk 18.

Figure 1:
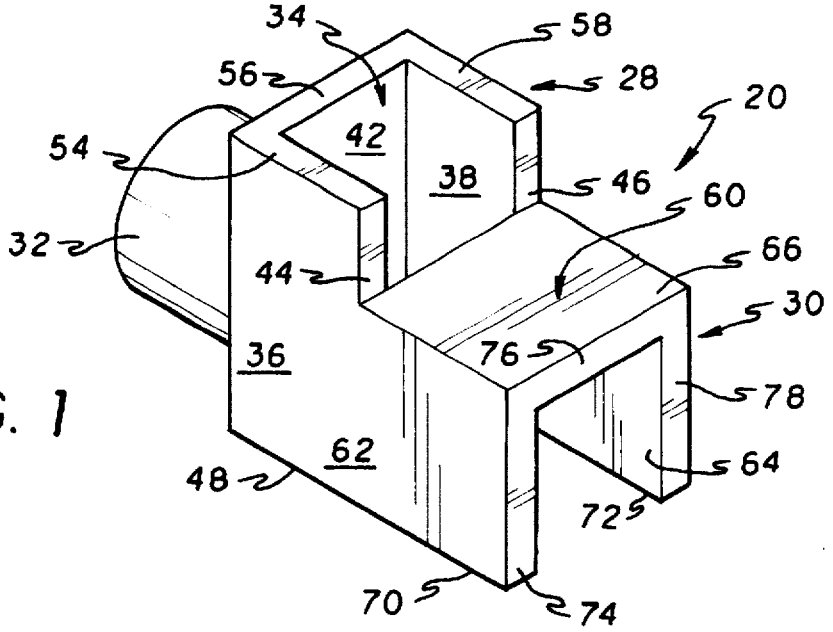
FIG. 1 is a front perspective view of the tree step socket of the present invention.
Figure 2:
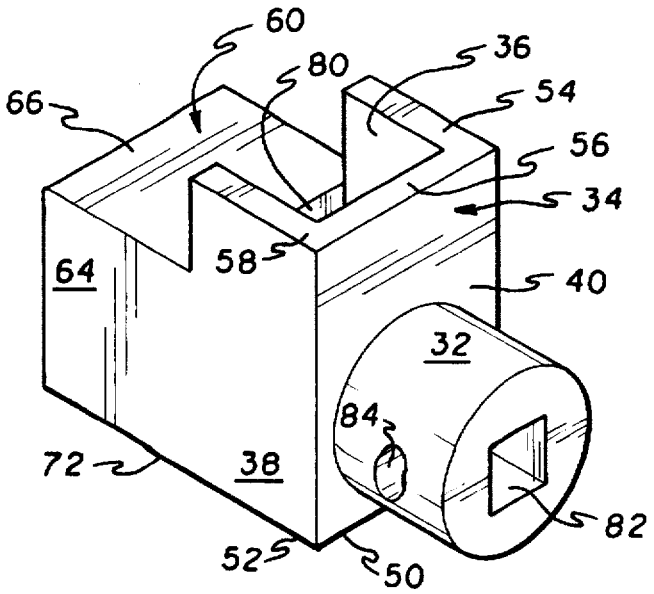
FIG. 2 is a rear perspective view of the tree step socket of the present invention.
Figure 3:
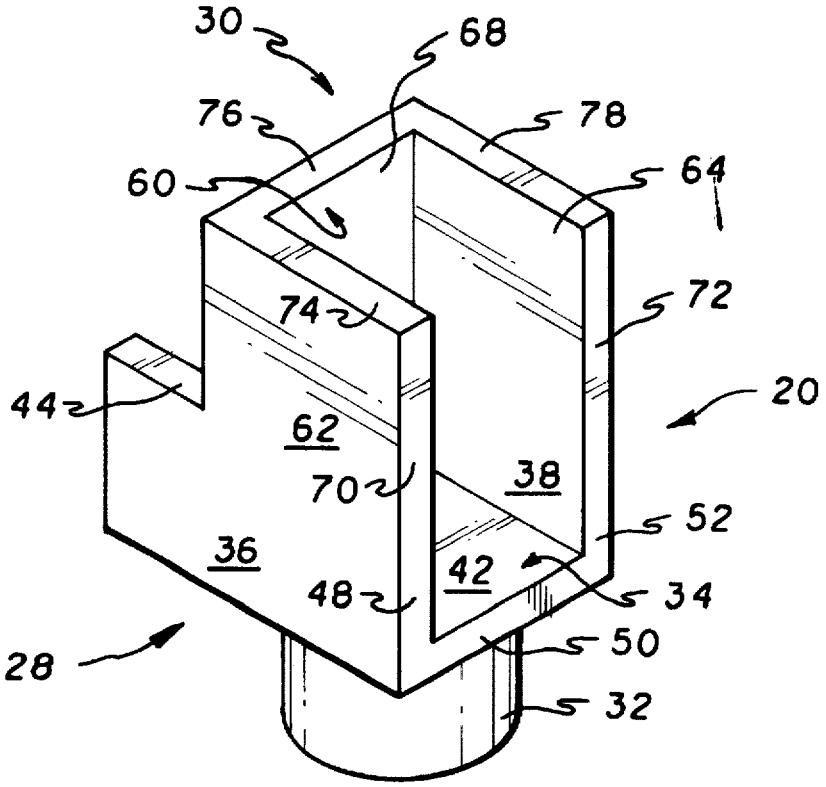
FIG. 3 is a bottom perspective view of the tree step socket of the present invention.
Figure 4:
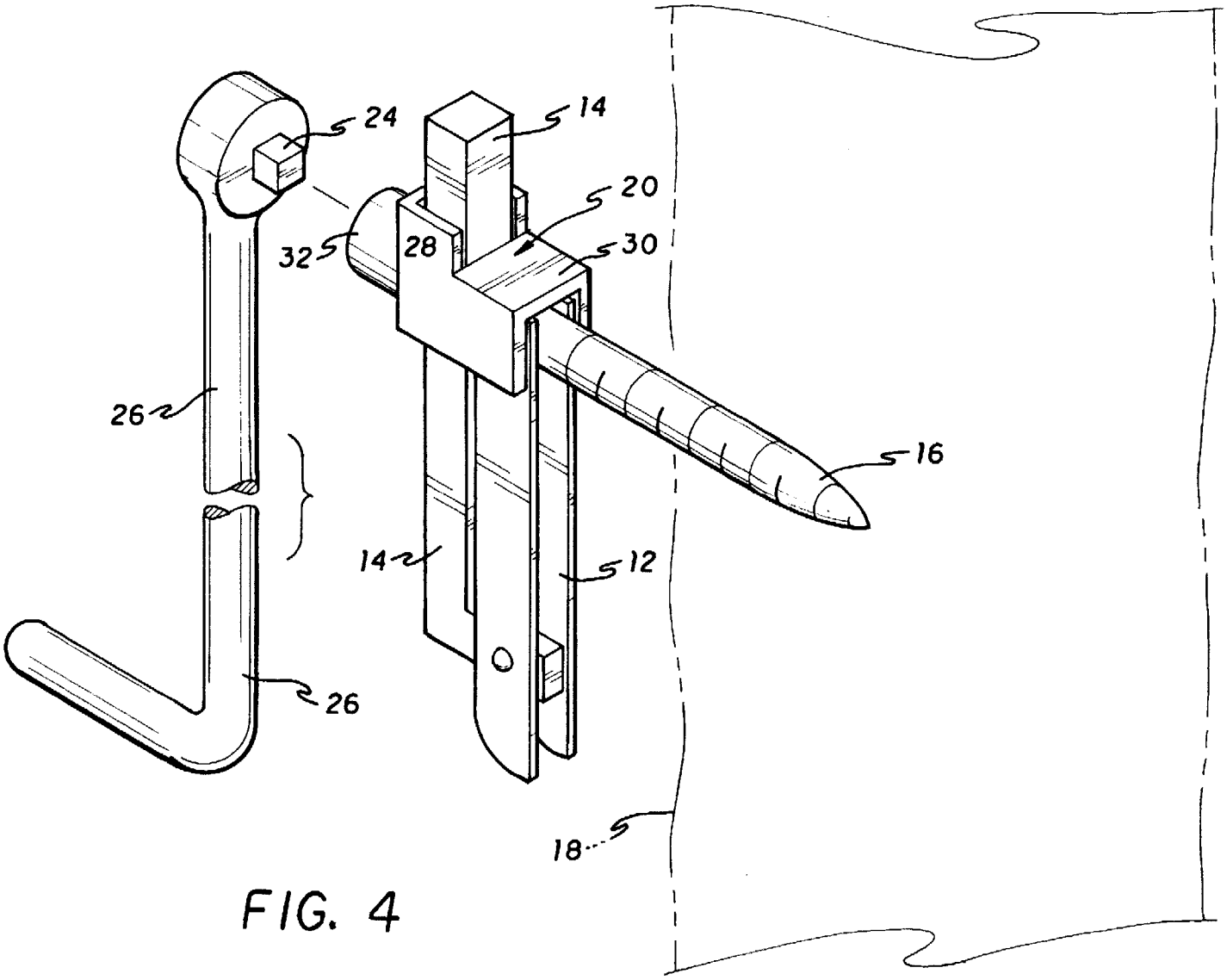
FIG. 4 is an environmental perspective view of the tree step socket of the present invention.

Referring to FIG. 4, with the foot peg 14 folded, the socket 20 of the present invention engages the tree step 10 in a manner such that rotation of the socket 20 causes the tree step 10 to revolve about the longitudinal axis of the screw portion 16. The socket 20 is also engageable with the socket attachment shaft 24 of the ratchet 22. Thus the ratchet 22 can be used to rotate the tree step 10 about the longitudinal axis of the screw portion 16 by using the socket 20. Because the handle 26 of the ratchet 22 is relatively long, the handle 26 provides a relatively long moment arm relative to the screw portion 16 of the tree step 10. Therefore, using the socket 20 and the ratchet 22, the screw portion 16 of the tree step 10 can be screwed into or unscrewed out of the tree trunk 18 with relative ease.

Referring to FIGS. 1–4, the socket 20 includes a first bracket 28, a second bracket 30, and a cylindrical projection 32. The first bracket 28 has a back wall 34, a first sidewall 36, and a second sidewall 38. The back wall 34 has a backside 40 and a front 42. The first sidewall 36 and the second sidewall 38 extend from the front 42 of the back wall 34, in a parallel and spaced apart relationship so as to define a trough having an open top, an open first end, and an open second end. The trough referred to above is merely a descriptive term used to describe the general shape of the first bracket 28.

To more clearly understand the terminology used above, consider an imaginary plane (not shown) defined by and containing the edges 44 and 46. This imaginary plane is the boundary between the first bracket 28 and the second bracket 30. If the brackets 28 and 30 were separated along this imaginary plane, the brackets 28 and 30 would resemble troughs, or gutters or roughly C-shaped cross section channels, each having an open top, an open first end, and an open second end. In the case of the first bracket 28, the open top would be defined by the edges 44 and 46 as would be extended if the brackets 28 and 30 were separated along the imaginary boundary plane described above. The open first end of the first bracket 28 would be defined by the edges 48, 50, and 52. The open second end of the first bracket 28 would be defined by the edges 54, 56, and 58.

The second bracket 30 has a back wall 60, a first sidewall 62, and a second sidewall 64. The back wall 60 has a backside 66 and a front 68. The first sidewall 62 and the second sidewall 64 extend from the front 68 of the back wall 60 in a parallel and spaced apart relationship so as to define a trough having an open top, an open first end, and an open second end. As with the first bracket 28, if the brackets 28 and 30 were delineated by the imaginary plane discussed above, the open top of the second bracket 30 would be defined by the edges 70 and 72. The open second end the second bracket 30 would be defined by the edges 74, 76, and 78. The open first end of the second bracket 30 would be defined by the edge 80 and the projection of the edges 74 and 78 onto the imaginary plane defined by and containing the edges 44 and 46.

The second bracket 30 extends perpendicularly from the open top of the first bracket 28 in a direction away from the back wall 34. The open first end of the second bracket 30 is coplanar with the open top of the first bracket 28. Also the first sidewall 62 of the second bracket is continuous with the first sidewall 36 of the first bracket, and the second sidewall 64 of the second bracket is continuous with the second sidewall 38 of the first bracket. Further, the second bracket 30 is preferably positioned along the edges 44 and 46 such that the longitudinal axis of the screw portion 16 will be in alignment with the longitudinal axis of the projection 32 when the socket 20 is being used to turn the tree step 10. The alignment of the longitudinal axis of the screw portion 16 with the longitudinal axis of the projection 32 can generally be achieved when the second bracket 30 is positioned relative to the first bracket 28 such that the open first end and the open second end of the second bracket 30 are in registry with the projection 32.

The projection 32 projects generally perpendicularly from the backside 40 of the back wall 34 of the first bracket 28. The projection 32 has a cavity 82 for receiving the socket attachment shaft 24 of the ratchet 22.

The exterior surface of the projection 32 is coaxial with the cavity 82. A transverse hole 84 extends from the exterior surface of the projection 32 to the cavity 82. The transverse hole 84 is capable of receiving a spring loaded ball (not shown) carried by the socket attachment shaft 24 of the ratchet 22. Such spring loaded balls are commonly used to secure sockets to ratchets such as ratchet 22. The cavity 82 is square in cross section to match the socket attachment shaft 24, however the cavity 82 can have any shape as long as that shape prevents the rotation of the socket 20 relative to the socket attachment shaft 24.

To use the socket 20, the screw portion 16 is unfolded to project perpendicularly from the main bar 12 while the foot peg 14 is folded to lie alongside the main bar 12 of the tree step 10. The socket 20 is then mounted to the tree step 10 such that a portion of the foot peg 14 lies between the first sidewall 36 and the second sidewall 38 of the first bracket 28, while the second bracket 30 surrounds the end of the main bar 12 to which the screw portion 16 is attached. The portion of the foot peg 14 lying between the first sidewall 36 and the second sidewall 38, simultaneously passes between the edge 80 and the front 42 of the back wall 34 of the first bracket 28.

With the socket 20 mounted to the tree step 10 in the manner described above, the socket attachment shaft 24 of the ratchet 22 is inserted in the cavity 82. The ratchet 22 can now be used to turn the tree step 10 about the longitudinal axis of the screw portion 16, to either screw the screw portion 16 into the tree trunk or unscrew the screw portion 16 from the tree trunk.

The socket 20 is preferably made of steel but can be made of other metals such as aluminum, brass, etc. Also it is possible to make the socket 20 from a rigid polymeric or composite material. In addition, the socket 20 can be of one piece construction or, for example, can be made by welding the brackets 28 and 30 together.

It is to be understood that the present invention is not limited to the sole embodiment described above, but encompasses any and all embodiments within the scope of the following claims.

We claim:

1. A socket for allowing a driver tool to be used to turn a tree step relative to a tree trunk, the tree step including a main bar having a first end and a second end, a foot peg hingedly attached to the first end of the main bar, and a screw portion hingedly attached to the second end of the main bar, the driver tool having a socket attachment shaft, said socket comprising:

a first bracket having a backside and an open front;

a second bracket extending substantially perpendicularly from said open front; and a projection projecting substantially perpendicularly from said backside, said projection having a cavity for receiving the socket attachment shaft of the driver tool, said cavity being square in cross section;

whereby when said second bracket surrounds the second end of the main bar; and when the socket attachment shaft of the driver tool engages said cavity, the driver tool can be used to turn the tree step relative to the tree trunk to perform one of screwing the screw portion of the tree step into the tree trunk and unscrewing the screw portion of the tree step from the tree trunk.

2. The socket according to claim 1, wherein said projection has an exterior surface that is coaxial with said cavity, and said projection further has a transverse hole extending from said exterior surface to said cavity, said transverse hole capable of receiving a spring loaded ball carried by the socket attachment shaft of the driver tool.

3. A socket for allowing a driver tool to be used to turn a tree step relative to a tree trunk, the tree step including a main bar having a first end and a second end, a foot peg hingedly attached to the first end of the main bar, and a screw portion hingedly attached to the second end of the main bar, the driver tool having a socket attachment shaft, said socket comprising:

a first bracket having a back wall, a first sidewall, and a second sidewall, said back wall of said first bracket having a backside and a front, said first sidewall of said first bracket and said second sidewall of said first bracket extending from said front of said back wall of said first bracket in a parallel and spaced apart relationship so as to define a trough having an open top, an open first end, and an open second end;

a second bracket having a back wall, a first sidewall, and a second sidewall, said back wall of said second bracket having a backside and a front, said first sidewall of said second bracket and said second sidewall of said second bracket extending from said front of said back wall of said second bracket in a parallel and spaced apart relationship so as to define a trough having an open top, an open first end, and an open second end, said second bracket extending perpendicularly from said open top of said first bracket away from said back wall of said first bracket, said open first end of said second bracket being coplanar with said open top of said first bracket, said first sidewall of said second bracket being continuous with said first sidewall of said first bracket, and said second sidewall of said second bracket being continuous with said second sidewall of said first bracket; and a projection projecting substantially perpendicularly from said backside of said back wall of said first bracket, said projection having a cavity for receiving the socket attachment shaft of the driver tool;

whereby when the foot peg is folded to lie alongside the main bar of the tree step, a portion of the foot peg can lie between said first sidewall of said first bracket and said second sidewall of said first bracket, the portion of the foot peg simultaneously passing between said open first end of said second bracket and said front of said back wall of said first bracket, while said second bracket surrounds the second end of the main bar; and when the socket attachment shaft of the driver tool is inserted in said cavity, the driver tool can be used to turn the tree step relative to the tree trunk to perform one of screwing the screw portion of the tree step into the tree trunk and unscrewing the screw portion of the tree step from the tree trunk.

4. The socket according to claim 3, wherein said projection has an exterior surface that is coaxial with said cavity, and said projection further has a transverse hole extending from said exterior surface to said cavity, said transverse hole capable of receiving a spring loaded ball carried by the socket attachment shaft of the driver tool.

5. The socket according to claim 3, wherein said cavity is square in cross section.

* * * * *